US006616541B2

(12) United States Patent
Michelizza

(10) Patent No.: US 6,616,541 B2
(45) Date of Patent: Sep. 9, 2003

(54) GOLF BALL PLACEMENT DEVICE

(76) Inventor: Giuseppe Michelizza, 2616 Falconbridge Hwy., Unit 1, Garson, Ontario (CA), P3L 1K6

( * ) Notice: Subject to any disclaimer, the term of this patent is extended or adjusted under 35 U.S.C. 154(b) by 0 days.

(21) Appl. No.: 10/050,576

(22) Filed: Jan. 18, 2002

(65) Prior Publication Data

US 2003/0139221 A1 Jul. 24, 2003

(51) Int. Cl.[7] ..... A63B 57/00
(52) U.S. Cl. ..... 473/132
(58) Field of Search ..... 473/132–137

(56) References Cited

U.S. PATENT DOCUMENTS 1,868,261 A * 7/1932 Spencer ..... 473/134
2,285,342 A * 6/1942 MacLellan ..... 473/137
4,141,558 A * 2/1979 Hoffman ..... 473/132
4,360,204 A * 11/1982 Karr ..... 473/137
4,391,446 A * 7/1983 Eberle ..... 473/137
5,282,628 A * 2/1994 Komori et al. ..... 473/136
5,860,870 A * 1/1999 Park ..... 473/136

* cited by examiner

*Primary Examiner*—Steven Wong
(74) *Attorney, Agent, or Firm*—Elias C. Borges

(57) ABSTRACT

A golf ball teeing device is disclosed. The device includes a housing having a ball storage compartment having an opening dimensioned to permit golf balls to pass there through. The housing has a ball selector which is adapted to permit only one golf ball to be moved out of the opening at one time. A placement arm is pivotally mounted to the housing adjacent the ball selector. The arm has a channel configured to permit golf balls to roll down the arm. The distal end of the arm has a projecting portion which is configured to remove the ball from the channel when the ball rolls past. The arm is pivotally movable in a substantially horizontal plane between a first position wherein the distal end is adjacent a placement point for the golf tee and a second position wherein the distal end is positioned away from the placement point.

5 Claims, 4 Drawing Sheets

GOLF BALL PLACEMENT DEVICE

FIELD OF THE INVENTION

The invention relates generally to devices for placing golf balls on driving range tees.

BACKGROUND OF THE INVENTION

Golfers who wish to practice their driving and swinging skills generally attend at driving ranges where, for a few dollars, they receive a bucket of golf balls and an environment where they can practice driving the golf balls. Generally these driving ranges consist of a mock fairway having a target at one end and a series of driving locations at the other end. Each of these driving locations generally consists of a platform having a matt of artificial turf and a rubber tubular tee mounted there to. The golfer generally places a golf ball on the rubber tee before attempting to strike the ball with his driver or golf club. Since the goal of the driving range is to improve the golfer's skills by permitting the golfer to repetitively drive balls, the golfer generally spends a considerable amount of time reaching down to place golf balls on the rubber tee. Repeated bending over to place golf balls can lead to back pain as well as frustration, particularly if the golfer wishes to practice his or her driving skills for an extended period of time.

To alleviate some of the problems associated with continually bending over to place golf balls, several prior art devices have been introduced which automatically place golf balls on the tee. These devices generally comprise a hopper or other similar device for storing a quantity of golf balls and a pivoting arm which grabs a golf ball from the hopper and then pivots to place the ball on the tee. A key step in the process of teeing a ball is the actual placement of the ball on the tee. Prior art devices have accomplished this task by providing a pivoting arm which places a ball on the tee by pivoting downward onto the tee. These automatic tee devices are often motorized.

While existing tee devices are generally effective in tee golf balls, they suffer from several drawbacks. Firstly, most existing devices are extremely complicated having many working parts, electric motors, switches, sensors and the like. As a result, these prior tee devices tend to be very cumbersome to operate and expensive to manufacture. Furthermore, existing tee devices do not always accurately place the ball on the tee, causing the ball to fall off of the tee. A simple and reliable device for tee balls is therefore required.

SUMMARY OF THE INVENTION

The present invention overcomes the drawbacks of the prior art by providing a golf ball teeing device comprising a housing having a ball storage compartment for storing a plurality of golf balls, said ball storage compartment having walls, a floor and an opening, the opening dimensioned to permit golf balls to pass there through. The housing has a ball selector positioned adjacent the opening of the ball storage compartment, the ball selector adapted to permit only one golf ball to be moved out of the opening at a time. The device also includes a placement arm having opposite first and second ends, the first end being pivotally mounted to the housing adjacent the ball selector. The placement arm has a first channel extending between the first and second ends, the first channel dimensioned and configured to permit golf balls to roll down the channel from the first end to the second end. The second end of the placement arm has a projecting portion positioned adjacent the first channel. The projecting portion is dimensioned and configured to remove the ball from the channel when the ball rolls past the projecting portion. The extension arm is pivotally movable in substantially horizontal plane between a first position wherein the second end is adjacent a placement point for the golf tee and a second position wherein the second end is positioned away from the placement point.

DETAILED DESCRIPTION OF THE INVENTION

Figure 1:
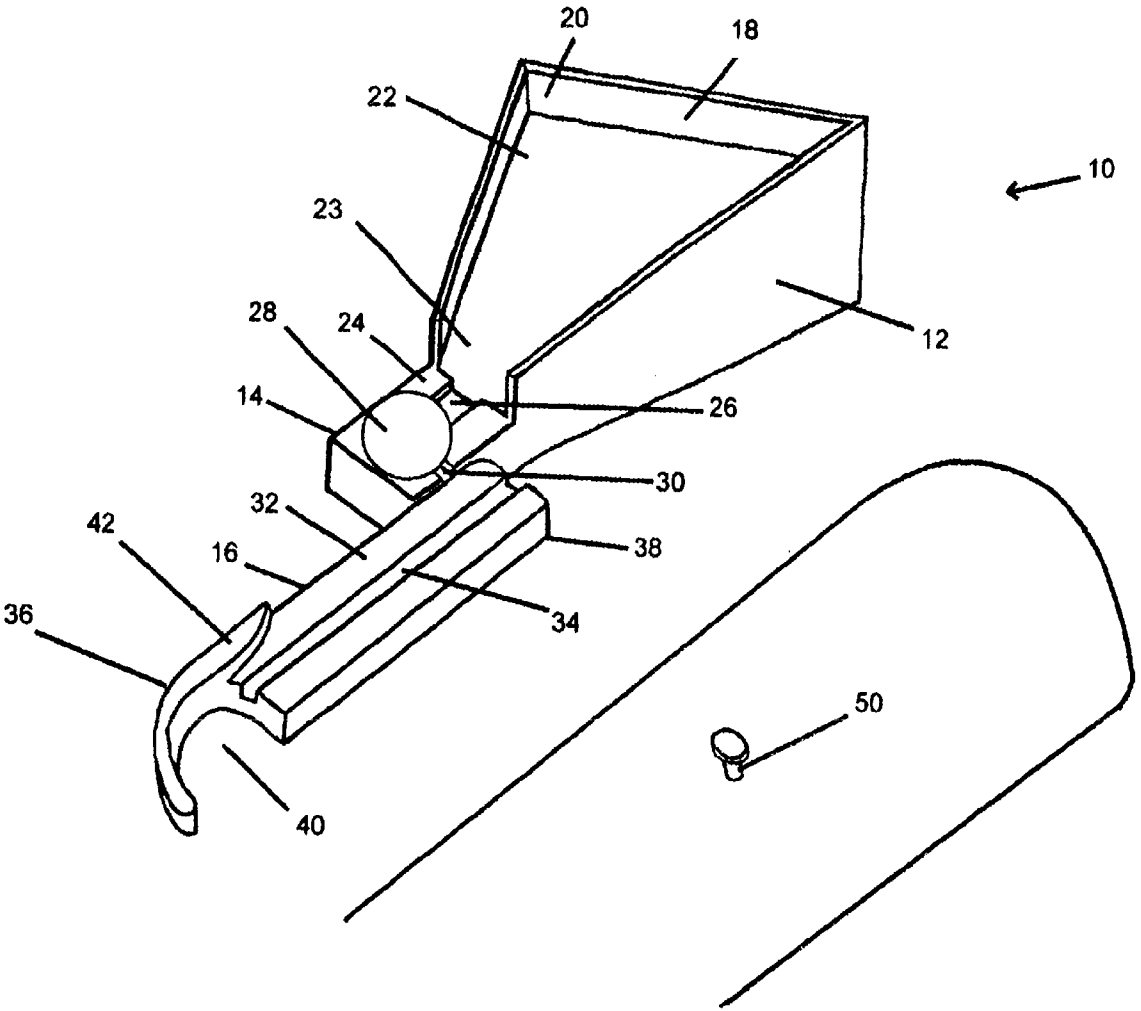
FIG. 1: is a perspective view of the present invention showing the positioning arm in it's first position.

Referring firstly to FIG. 1, a golf ball positioning device made in accordance with the present invention is shown generally as item 10 and comprises a golf ball storage compartment 12, operably coupled to a ball selector 14 which in turn is operably coupled to a pivoting placement arm 16. Ball storage compartment 12 preferably comprises a hopper having compartment 18, walls 20, downward slopping floor 22 and opening 23. Ball storage compartment 12 is configured to hold several golf balls 28 within chamber 18. Slopping floor 22 permits the golf balls to roll down towards opening 23. Opening 23 is dimensioned to permit only one golf ball to pass through at a time. The remainder of the golf balls are restrained from moving out of chamber 18 by walls 20.

Figure 3:
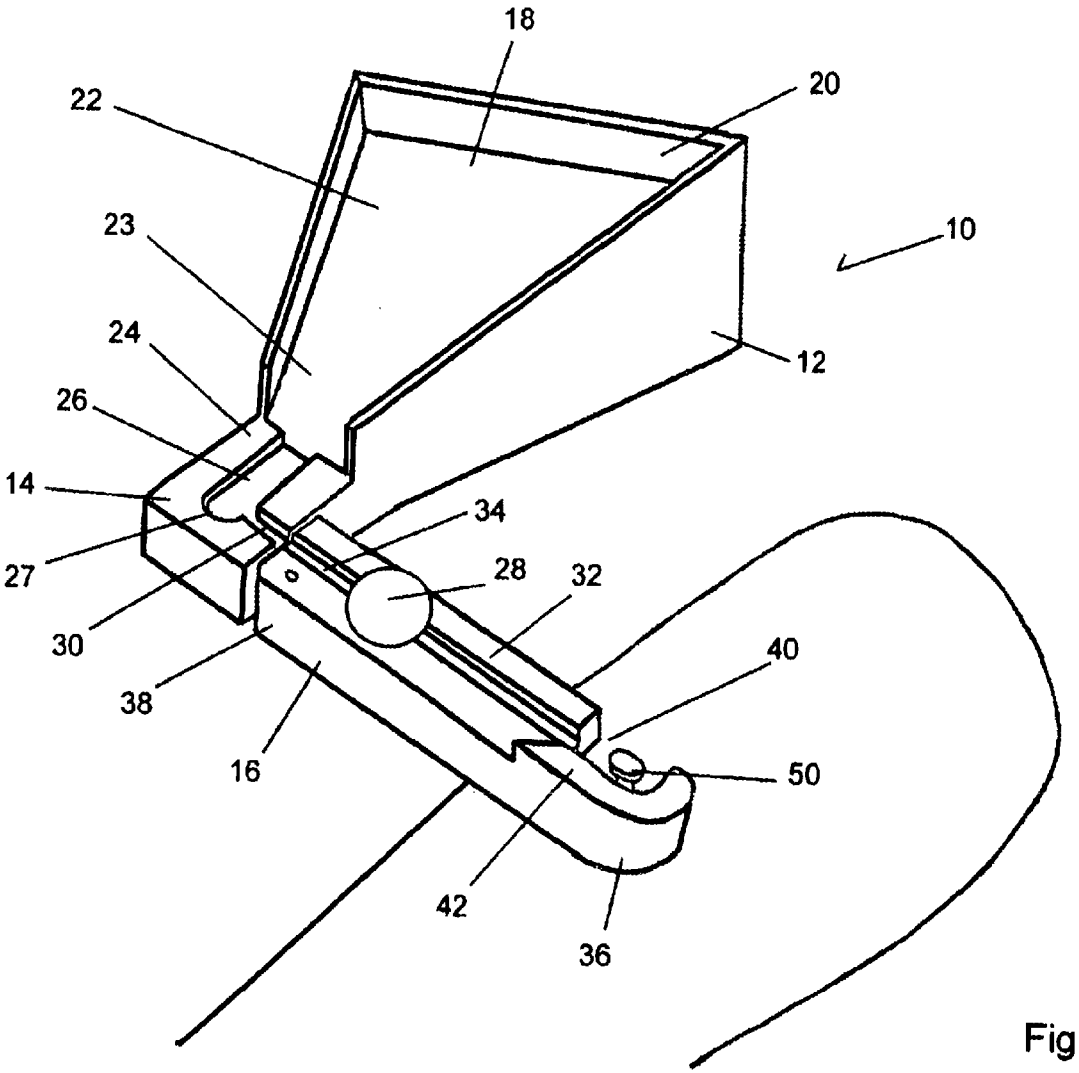
FIG. 3: is a perspective view of the present invention showing the positioning arm in it's second position and a golf ball being positioned towards the tee.

Referring now to FIG. 3, ball selector 14 comprises a platform 24 having a first channel 26 which is dimensioned and configured to permit a golf ball 28 to roll along channel 26. Platform 24 is also provided with a second channel 30 which extends perpendicularly from first channel 26. Channel 26 terminates at end 27 which is adjacent to channel 30. Channel 26 and end 27 are dimensioned and configured to hold a golf ball within the channel.

Referring back to FIG. 1, positioning arm 16 comprises an elongated member having first end 38, second end 36 and top surface 32. First end 38 is pivotally mounted to ball selector 14. Top surface 32 of positioning arm 16 has an elongated channel 34. Channel 34 is dimensioned and configured to permit a golf ball 28 to roll along the channel without falling off of surface 32. End 36 of positioning arm 16 has protrusion 42 which extends from surface 32. End 36 curves to form recess 40, which is sufficiently wide to permit golf ball 28 to pass there through.

Figure 2:
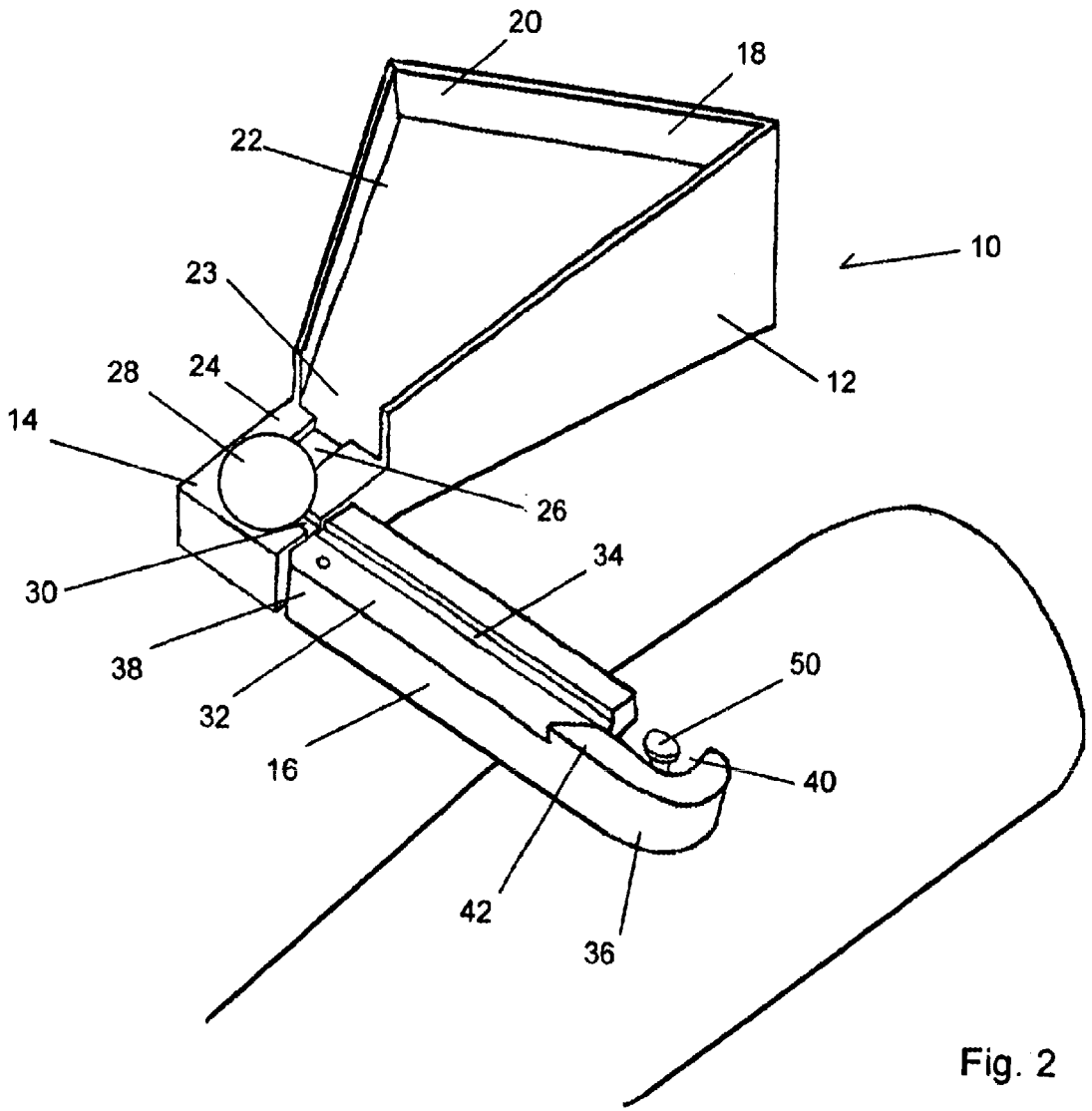
FIG. 2: is a perspective view of the present invention showing the positioning arm in it's second position.

Referring now to FIGS. 1 and 2, positioning arm 16 is pivotally movable between a first position as shown in FIG. 1 where channels 34 and 30 are not alined, and a second position where end 36 of the positioning arm encloses tee 50 and channels 34 and 30 are aimed.

Referring now to FIG. 3, when positioning arm 16 is in it's second position, a golf ball 28 may be moved from channel 26 of ball selector 14 into channel 34 of the positioning arm. Projection 42 is dimensioned and configured to urge golf ball 28 out of channel 34 as golf ball 28 is rolled towards tee 50. End 36 of positioning arm 16 is curved thereby permitting tee 50 to be positioned within recess 40. Projection 42 extends all the way around end 36 preventing golf ball 28 from rolling off tee 50 when the ball is positioned on the tee.

The operation of the golf positioning device will now be explained. Referring to FIG. 1, device 10 is first set down adjacent golf tee 50 at a position which permits tee 50 to be within recess 40 of positioning arm 16 when the positioning arm is in it's second position. A number of golf balls are then loaded into chamber 18 of ball storage unit 12. The balls then roll down floor 22 towards opening 23. Opening 23 permits only one golf ball to enter channel 26 at a time. Platform 24 and channel 26 is sufficiently long to permit at least one golf ball 28 to rest in channel 26.

Referring now to FIG. 2, positioning arm 16 is then swung into it's second position by the player. The player accomplishes the swinging of arm 16 using the head of his or her golf club without the need to bend over. With arm 16 in it's second position, tee 50 is positioned within recess 40 and is alined with channel 34 so that a ball rolling down channel 34 will come to rest on tee 50.

Figure 4:
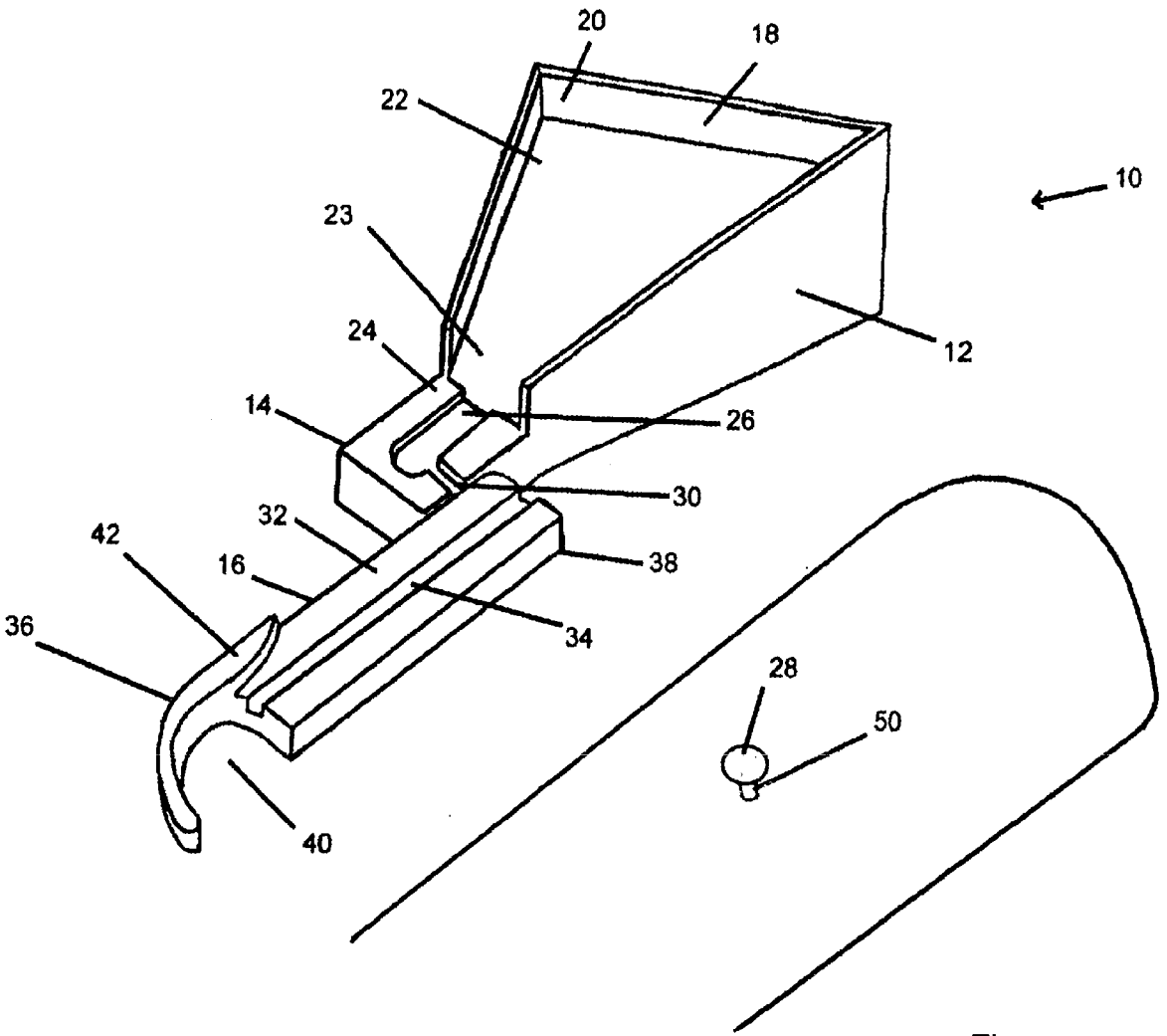
FIG. 4: is a perspective view of the present invention showing the golf ball positioned on the tee and the positioning arm moved back to it's first position.

Referring now to FIG. 3, the player, again using the head of his club, urges golf ball 28 onto arm 16 and down channel 34. As ball 28 reaches end 36, projection 42 urges the ball onto tee 50. The golfer then uses his golf ball to position arm 16 back into it's first position as shown in FIG. 4. The golfer may then attempt to hit the ball with his club.

The specific embodiment of the present invention has been disclosed; however, several variations of the disclosed steps could be envisioned as within the scope of this invention. It is to be understood that the present invention is not limited to the embodiments described above, but encompasses any and all embodiments within the scope of the following claims.

What is claimed is:

1. A device for assisting a user in placing a golf ball on a golf tee, said device comprising:

(a) a housing having a ball storage compartment for storing a plurality of golf balls, said ball storage compartment having walls, a floor and an opening, the opening dimensioned to permit golf balls to pass there through, (b) the housing having a ball selector positioned adjacent the opening of the ball storage compartment, the ball selector adapted to permit only one golf ball to be moved but of the opening at a time, (c) a placement arm having opposite first and second ends, the first end being pivotally mounted to the housing adjacent the ball selector, the placement arm having a first channel extending between the first and second ends, the first channel dimensioned and configured to permit golf balls to roll down the channel from the first end to the second end, the second end of the arm having a projecting portion positioned adjacent the first channel, the projecting portion dimensioned and configured to remove the ball from the channel when the ball rolls past the end portion, the extension placement arm pivotally movable in a substantially horizontal plane between a first position wherein the second end is adjacent a placement point for the golf tee and a second position wherein the second end is positioned away from the placement point, (d) wherein the ball selector comprises a substantially flat member having a fat top surface and a passage, the passage formed as a groove on the top surface, the passage dimensioned and configured to permit golf balls to travel along the passage in single file, the passage having an entry point positioned adjacent the opening of the ball compartment the passage having a exit point positioned adjacent the first channel at the first end of the positioning arm, and (e) wherein the first and second elongated portions of the groove of the ball sector have a first and second diameter, respectively, the diameter of the first elongated portion of the groove being greater than the diameter of the second elongated portion of the groove.

2. A device as defined in claim 1 wherein the placement arm has a flat surface and wherein the first channel comprises an elongated groove on the top surface of the placement arm, the groove of the placement arm having a first portion adjacent the first end of the placement arm, the fit end of the groove of the placement arm positioned adjacent the exit point of the second elongated portion of the groove of the ball selector.

3. A device as defined in claim 1 wherein the placement arm has an elongated flat surface extending substantially along the placement arm between the first and second ends of the placement arm and wherein the first channel comprises an elongated groove on the top surface of the placement arm, the groove of the placement arm having a first portion adjacent the first end of the placement arm and a second portion adjacent the second end of the placement arm.

4. A device as defined in claim 3 wherein the flat surface of the placement arm includes a placement portion adjacent the second end of the placement arm, the projecting portion of the arm extending into the placement portion.

5. A device as defined in claim 4 wherein the projecting portion forms a curved end, the curved end dimensioned and configured to guide the golf ball onto the placement point.

* * * * *